US011719072B2

(12) United States Patent
Kshirsagar et al.

(10) Patent No.: US 11,719,072 B2
(45) Date of Patent: Aug. 8, 2023

(54) WELL SEALING TOOL WITH ISOLATABLE SETTING CHAMBER

(71) Applicant: Halliburton Energy Services, Inc., Houston, TX (US)

(72) Inventors: Mukesh Bhaskar Kshirsagar, Singapore (SG); Abhay Raghunath Bodake, Singapore (SG); Ashishkumar M. Waghumbare, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 16 days.

(21) Appl. No.: 17/528,253

(22) Filed: Nov. 17, 2021

(65) Prior Publication Data

US 2023/0151715 A1 May 18, 2023

(51) Int. Cl.

| | |
|---|---|
| ***E21B 34/10*** | (2006.01) |
| ***E21B 23/06*** | (2006.01) |
| ***E21B 33/128*** | (2006.01) |
| ***E21B 33/134*** | (2006.01) |

(52) U.S. Cl.

CPC ..... *E21B 34/10* (2013.01); *E21B 23/06* (2013.01); *E21B 33/1285* (2013.01); *E21B 33/134* (2013.01); *E21B 2200/04* (2020.05)

(58) Field of Classification Search

CPC ..... E21B 34/10; E21B 23/06; E21B 33/1285; E21B 2200/04

See application file for complete search history.

(56) References Cited

U.S. PATENT DOCUMENTS

| | | | | |
|---|---|---|---|---|
| 2,737,245 A * | 3/1956 | Granville | E21B 23/06 166/325 |
| 4,367,794 A * | 1/1983 | Bednar | E21B 21/10 175/242 |
| 4,791,992 A | 12/1988 | Greenlee et al. | |
| 5,277,253 A * | 1/1994 | Giroux | E21B 33/128 166/187 |

(Continued)

FOREIGN PATENT DOCUMENTS

| | | |
|---|---|---|
| EP | 2767669 | 8/2014 |
| WO | 2008-021703 | 2/2008 |
| WO | 2020145938 A1 | 7/2020 |

OTHER PUBLICATIONS

International Search Report and Written Opinion for Application No. PCT/US2021/060907, dated Aug. 8, 2022.

*Primary Examiner* — Jonathan Malikasim

(74) *Attorney, Agent, or Firm* — Scott Richardson; C. Tumey Law Group PLLC

(57) ABSTRACT

A well sealing tool may include a hydraulic setting mechanism wherein a setting chamber is isolated after setting a sealing element in engagement with a wellbore. In one example, a setting mechanism includes a setting chamber housing positionable about a mandrel to define at least a portion of a setting chamber between the mandrel and the setting chamber housing. A setting port fluidically couples a through bore of the mandrel with the setting chamber. A valve element is biased toward a closed position within the setting port. A guide sleeve is disposed about the mandrel in a first position that props the valve element to an open position. The guide sleeve is moveable to a second position in response to a threshold pressure applied to the setting chamber to release the valve element to the closed position.

20 Claims, 4 Drawing Sheets

(56) References Cited

U.S. PATENT DOCUMENTS

| | | | | |
|---|---|---|---|---|
| 5,375,662 | A | 12/1994 | Echols, III et al. | |
| 5,845,711 | A | 12/1998 | Connell et al. | |
| 2009/0255692 | A1* | 10/2009 | Coronado | E21B 33/128 166/387 |
| 2013/0087322 | A1* | 4/2013 | Rowe | E21B 33/127 166/120 |
| 2016/0230505 | A1 | 8/2016 | Garcia et al. | |
| 2019/0093449 | A1* | 3/2019 | Sanchez | E21B 33/1285 |
| 2019/0264536 | A1* | 8/2019 | Abeidoh | E21B 23/04 |
| 2021/0115745 | A1 | 4/2021 | Kadam et al. | |

* cited by examiner

WELL SEALING TOOL WITH ISOLATABLE SETTING CHAMBER

BACKGROUND

Wells are drilled to recover valuable hydrocarbons such as oil and gas deep within the earth. The construction and servicing of a well typically involves long strings of tubular equipment. For example, a wellbore may be drilled with a drill string progressively assembled from segments of drill pipe to reach the desired well depth. A wellbore is often lined with a tubular casing string, which may be perforated for extracting hydrocarbon fluids from a production zone. Alternatively, a tubular work string may be lowered into an encased ("open hole") portion of a well to seal off and deliver a stimulation treatment to selected production zones. In the process of completing the well, a production tubing string may be run into the well, providing a flow path from the production zone to a wellhead through which the oil and gas can be produced.

It is often necessary to seal an annulus between tubular members downhole. For example, one or more production zones may be isolated by setting packers at different intervals of the wellbore to seal an annulus between a tubular work string and the formation. Sealing devices are also sometimes deployed to seal between tubular members such as a work string and casing. Such sealing devices are often required to seal at very high pressure. For example, hydraulic fracturing (fracking) involves the delivery of a proppant-laden fluid at sufficiently high pressure to fracture the formation. A challenge in downhole sealing systems is to design robust mechanisms that withstand these high pressures, yet fit within the tight downhole confines.

BRIEF DESCRIPTION OF THE DRAWINGS

These drawings illustrate certain aspects of some of the embodiments of the present disclosure and should not be used to limit or define the method.

DETAILED DESCRIPTION

The disclosure has identified that high pressure differentials can be problematic, especially with packers designed to be set with low setting forces. Large pressure differentials between a setting pressure and a well servicing fluid pressure require stricter material and geometry limitations, which increases costs. In particular, if the setting chamber of a packer is going to see higher differentials after packer set, it must be designed to withstand this differential. The disclosure is directed in part to a setting mechanism wherein the setting chamber is subsequently isolated from tubing pressure after setting. This allows the setting mechanism to be designed according to a lower pressure rating, which is more cost efficient.

In examples, a well sealing tool includes a hydraulic setting mechanism that may be pressure-isolated after setting the well sealing tool downhole. In examples discussed below the well sealing tool is embodied as a packer that includes a sealing element for sealing an annulus between a tool string and the wellbore. The setting mechanism includes a setting chamber that uses fluid pressure to both deploy the sealing element and to then close the setting chamber. By pressure-isolating the setting chamber, a service fluid may then be delivered along the through bore of the well sealing tool at a fluid pressure greater than the fluid pressure used to set the sealing element.

Figure 1:
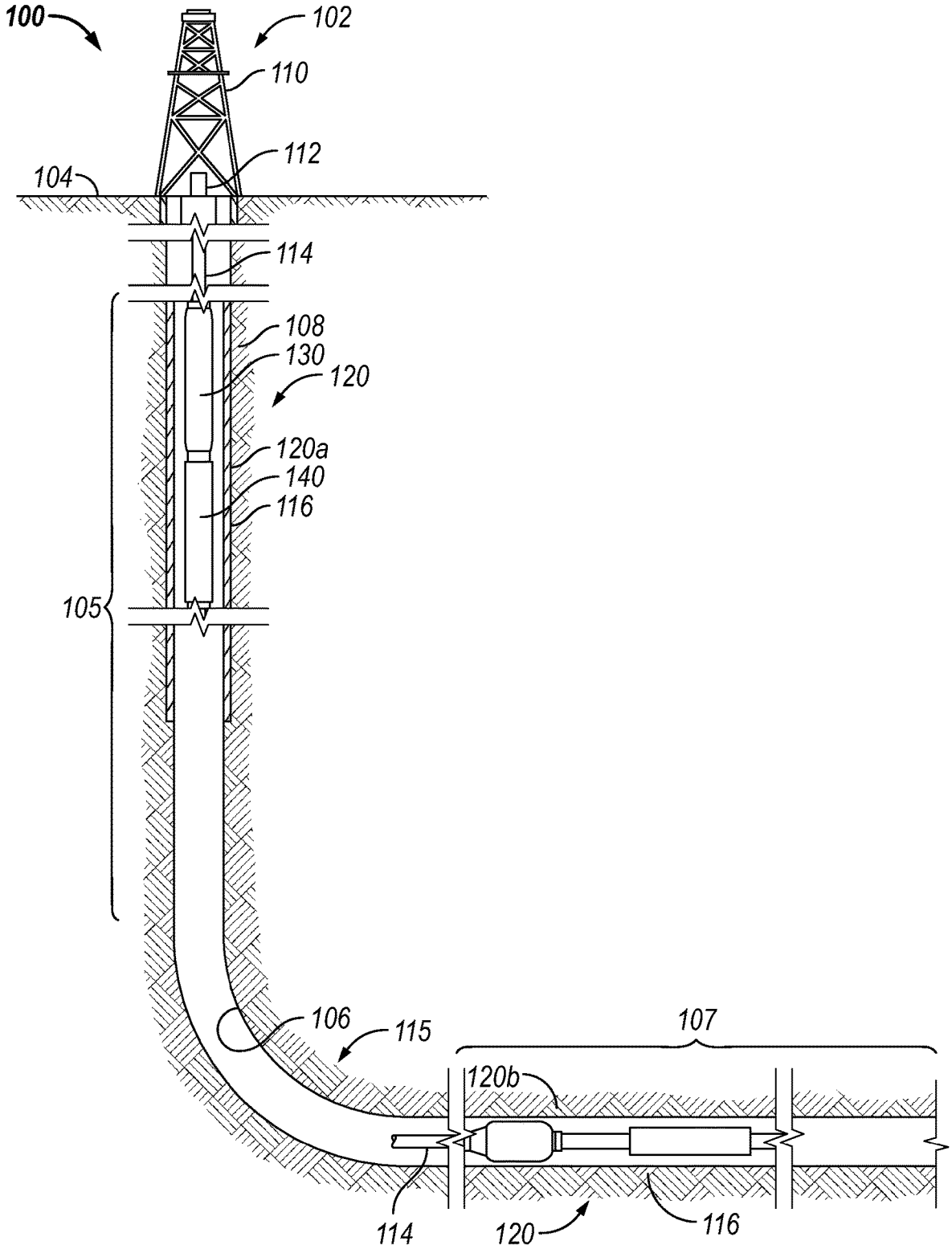
FIG. 1 is an elevation view of a well system in which one or more wellbore sealing tools may be deployed downhole.

FIG. 1 is an elevation view of a well system 100 in which one or more wellbore sealing tools (e.g., a packer 120) may be deployed downhole. The well system 100 may include an oil and gas rig 102 arranged at the earth's surface 104. The rig 102 may include a large support structure, such as a derrick 110, erected over the wellbore 106 on a support foundation or platform, such as a rig floor 112. Even though certain drawing features of FIG. 1 depict a land-based oil and gas rig 102, it will be appreciated that the embodiments of the present disclosure are useful with other types of rigs, such as offshore platforms or floating rigs used for subsea wells, and in any other geographical location. For example, in a subsea context, the earth's surface 104 may be the floor of a seabed, and the rig floor 112 may be on the offshore platform or floating rig over the water above the seabed. A subsea wellhead may be installed on the seabed and accessed via a riser from the platform or vessel.

A wellbore 106 may be drilled through the various strata of an earthen formation 108 according to a wellbore plan. The wellbore 106 may be drilled along a desired wellbore path from where the wellbore 106 is initiated at the surface 104 (i.e., the "heel") to the end of the well (i.e., the "toe"). The initial portion of the wellbore 106 is typically vertically downward as the drill string would generally be suspended vertically from the rig 102. Thereafter the wellbore 106 may deviate in any direction as measured by azimuth or inclination, which may result in sections that are vertical, horizontal, angled up or down, and/or curved. The term uphole generally refers to a direction along the wellbore path toward the surface 104 and the term downhole generally refers to a direction toward the toe at the end of the well, without regard to whether a feature is vertically upward or vertically downward with respect to a reference point. The wellbore path in FIG. 1 is simplified for ease of illustration, and is not to scale. In this example, the wellbore path includes an initial, vertical section 105, followed by at least one deviated section 115 downhole of the vertical section 105, which transitions from the vertical section 105 to a horizontal or lateral section 107 downhole of the curved section 115. Thus, the vertical section 105 is uphole of the curved section 115 and lateral section 107.

The wellbore 106 may be at least partially cased with a string of casing 116 at selected locations within the wellbore 106, while other portions of the wellbore 106 may remain uncased. In FIG. 1, by way of example, the casing 116 is shown along just a portion of the vertical section 105 and the remainder of the wellbore 106 is shown as open hole. The casing 116 may be secured within the wellbore 106 using cement. In other embodiments, the casing 116 may be omitted entirely.

A hoisting apparatus (not shown) may be suspended from the rig 102 for raising and lowering equipment in the wellbore 106 on a tubular conveyance 114. The conveyance 114 may also be used to convey fluids, and to support electrical communication, power, and fluid transmission during wellbore operations. The conveyance 114 may include any suitable equipment for mechanically conveying tools. Such conveyance may include, for example, a tubular string made up of interconnected tubing segments, coiled tubing, or any combination of the foregoing. In some examples, conveyance 114 may provide mechanical suspension, as well as electrical and fluidic connectivity, for downhole tools. The conveyance 114 may be used to lower one or more tools into the wellbore 106, i.e. run/tripped into the hole. When a wellbore operation is complete, or when it becomes necessary to exchange or replace tools or components of the conveyance 114, the conveyance 114 may be raised or fully removed from the wellbore 106, i.e., tripped out of the hole.

A variety of wellbore sealing tools may be configured according to this disclosure. A packer 120 is one example of a wellbore sealing tool for discussion purposes. The packer includes a sealing element 130 and a hydraulic setting mechanism 140 for deploying the sealing element 130 into engagement with the wellbore 106 or other sealing surface. The sealing element 130 is alternately referred to in the art as the "element" of a packer, and the process of deploying the element into engagement with the sealing surface may be referred to as "setting" the packer 120. The packer 120 is shown in a first example location 120*a* in a run-in condition as it is being lowered into a wellbore 106, i.e., run in hole (RIH), and a second location 120*b* where the packer 120 has been set. One packer 120 is shown for ease of discussion, but it is understood that any number of packers may be run in hole on a work string to be deployed to different locations along the wellbore 106.

Various types of packers exist. Examples of packers include production packers that may be permanently set and service packers that may be retrievable. As just one example, the packer 120 in FIG. 1 may be a production packer that will remain in the well during well production. Another example is a service packer used temporarily during well servicing, such as for cementing, acidizing, or fracturing. When set, multiple packers 120 may be used to isolate zones of the annulus between wellbore 106 and a tubing string by providing a seal between production tubing and casing 116 or between production tubing and open hole. In examples, a packer may be disposed on production tubing.

Figure 2:
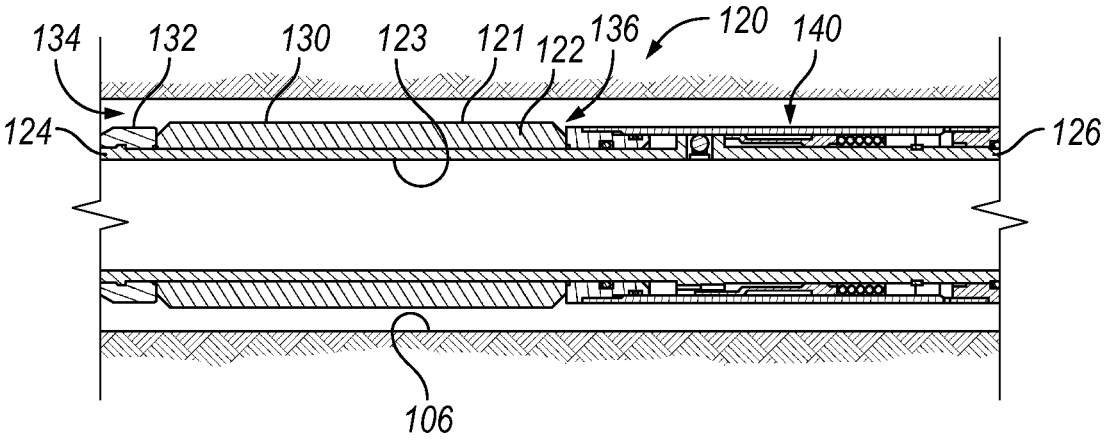
FIG. 2 is a sectional view of the packer disposed in the wellbore in a run-in condition according to one example configuration.

FIG. 2 is a sectional view of the packer 120 disposed in the wellbore 106 in a run-in condition according to one example configuration. A mandrel 122 is a centrally disposed, elongate, tubular, structural member at which the packer 120 may be connected within a tool string. The mandrel 122 in this example includes an uphole end 124 for directly or indirectly coupling to a conveyance or a tool string supported on the conveyance, and a downhole end 126. Other tool string components (not shown) may be coupled to the downhole end 126, such as other packers. The mandrel 122 extends through the packer 120 and supports various packer component thereon. The mandrel 122 may include a circular cross section with an outer diameter (OD) 121 and an inner diameter (ID) 123. The ID 123 may be defined by a mandrel through bore 125. The mandrel OD 121 is useful for externally supporting the various packer components in an annulus between the mandrel 122 and the wellbore 106 in which the packer 120 is disposed. The mandrel OD 121 may also provide a generally straight, cylindrical surface allowing for relative axial movement between certain packer components and the mandrel 122. The through bore 125 is useful for conveying fluids through the packer 120 within ID 123, such as production fluids flowing up from the downhole end 126 and well servicing fluids flowed downhole from surface via the tubular conveyance.

The packer 120 includes a sealing element ("element") 130 and a setting mechanism 140 for setting the element 130. The element 130 comprises a compliant, elastically-deformable material, such as a rubber or elastomer. The element 130 is supported on the mandrel OD 121 and is axially restrained at a first end 134, such as with a shroud 132. An opposing second end 136 of the element 130 may be slidable along the mandrel OD 121 toward the first end 134. When it is desired to set the element 130, the setting mechanism 140 may be used to urge the second end 136 of the element 130 toward the axially-constrained first end 134. The resulting axial compression of the element 130 will correspondingly squeeze the element 130 to deploy the element 130 outwardly into engagement with the wellbore 106. The setting mechanism 40 is hydraulically actuated by supplying a pressurized fluid downhole through the mandrel ID 123, as further discussed below.

Figure 3:
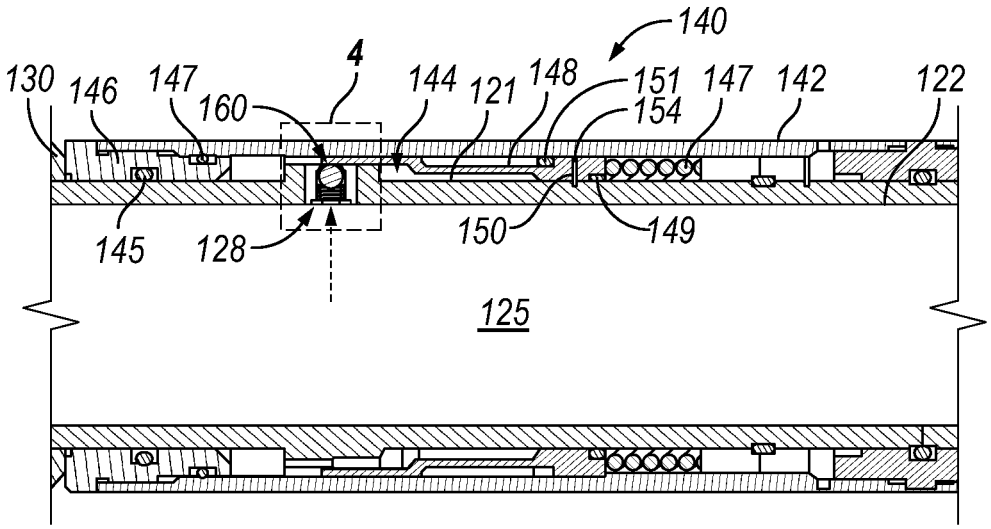
FIG. 3 is a sectional view of the setting mechanism in the run-in condition according to the example configuration of FIG. 2.

FIG. 3 is a sectional view of the setting mechanism 140 in the run-in condition according to the example configuration of FIG. 2. A setting chamber housing 142 disposed about the mandrel 122 defines at least a portion of an annular setting chamber 144 between the mandrel OD 121 and the setting chamber housing 142. A setting port 128 along the mandrel 122 fluidically couples the mandrel through bore 125 with the setting chamber 144, so that fluid pressure may be supplied to the setting chamber 144 via the setting port 128. The fluid pressure may be supplied downhole from the surface of the well site through a tubular conveyance in fluid communication with the mandrel 122. A valve element 160 in the setting port 128 is moveable between open and closed positions to open and close the setting port 128. A moveable guide sleeve 148 initially props a valve element 160 to the open position, but may be moved to release the valve element 160 to the closed position to isolate the setting chamber after setting the packer 120, as further described below.

An element-setting piston 146 is slidably disposed on the mandrel OD 121. The element-setting piston 146 may be sealed between the mandrel OD 121 and a surface of the setting chamber housing 144 with corresponding seals (e.g., O-rings) 145, 147. A guide sleeve piston 150 is also slidably disposed on the mandrel OD 121, sealed between the mandrel OD 121 and setting chamber housing 142 with corresponding seals (e.g., O-rings) 149, 151. The seals 149, 151 may also help avoid any communication from annulus and tubing after the setting port 128 is closed. The element-setting piston 146 and guide sleeve piston 150 are each exposed to (and may define respective portions of) the setting chamber 144. The element-setting piston 146 and guide sleeve piston 150 are axially opposite one another with respect to the setting port 128 in this configuration. The guide sleeve 148 is coupled to the guide sleeve piston 150 and may be unitarily formed therewith.

The element-setting piston 146 and the guide sleeve piston 150 are each moveable in response to pressure supplied to the setting chamber 144. A setting pressure may be supplied to the setting chamber 144 to urge the element-setting piston 146 into engagement with the sealing element 130 to deploy the sealing element 130 into engagement with the wellbore 106. The packer 120 may be configured to require a certain threshold pressure to move the guide sleeve piston 150. In the present example, this is accomplished with a shear member 154 to initially retain the guide sleeve 148 in a first position. The shear rating of the shear member 154 may be selected to control the amount of pressure required to initially move the guide sleeve piston 150 relative to the amount of pressure required to move the element-setting piston 160. For example, the shear member 154 may be configured to fail at a threshold pressure in excess of the setting pressure. This allows the packer to be set prior to shifting the guide sleeve 148 to release the valve element 160 and isolate the setting chamber 144. The use of a shear member to releasably secure the guide sleeve 148 is economical and reliable. However, any other suitable mechanism for securing the guide sleeve 148 (e.g., collets, dogs, etc.) and subsequently releasing by application a threshold pressure is also considered within the scope of the disclosure.

The setting mechanism 140 may also work even if configured so the threshold pressure required to move the guide sleeve piston 150 is less than the setting pressure used to set the sealing element 130. For example, in the illustrated configuration, a pressure may be supplied to both set the packer and fail the shear member 154 concurrently. That pressure may be maintained to avoid shifting the guide sleeve 148 and closing the setting port 128 until after the packer 120 is fully set. After the packer 120 is set, the pressure in the setting chamber 144 may be bled down to allow the guide sleeve 148 to gradually release the valve element 160 to the closed position.

A biasing member, such as a spring 147, may be provided to bias the guide sleeve 148 from the first position of FIG. 3 to a second position (e.g., FIG. 6, discussed below). The spring 147 is currently compressed in FIG. 3 while the shear member 154 remains intact. The compression of the spring 147 is what provides the biasing action in this example toward the second position, although any other biasing member and biasing configuration may be considered within the scope of this disclosure. The shear member 154 may resist movement of the guide sleeve piston in either axial direction. Thus, the shear member 154 may prevent the spring 147 from urging the guide sleeve 148 to the closed position (to the left in FIG. 3) until the shear member 154 is first failed by supplying the threshold pressure to the setting chamber 144 (to the right in FIG. 3). Then, once the shear member 154 is failed and the pressure bled off, the guide sleeve 148 may then be free to move to the second position under the biasing action of the spring 147 to release the valve element 160. Thus, in the process of isolating the setting chamber 144, the guide sleeve 148 first moves axially away from the setting port 128 in response to the threshold pressure, and the spring 147 then biases the guide sleeve 148 back toward the setting port 128 in response to bleeding off the threshold pressure.

Figure 4:
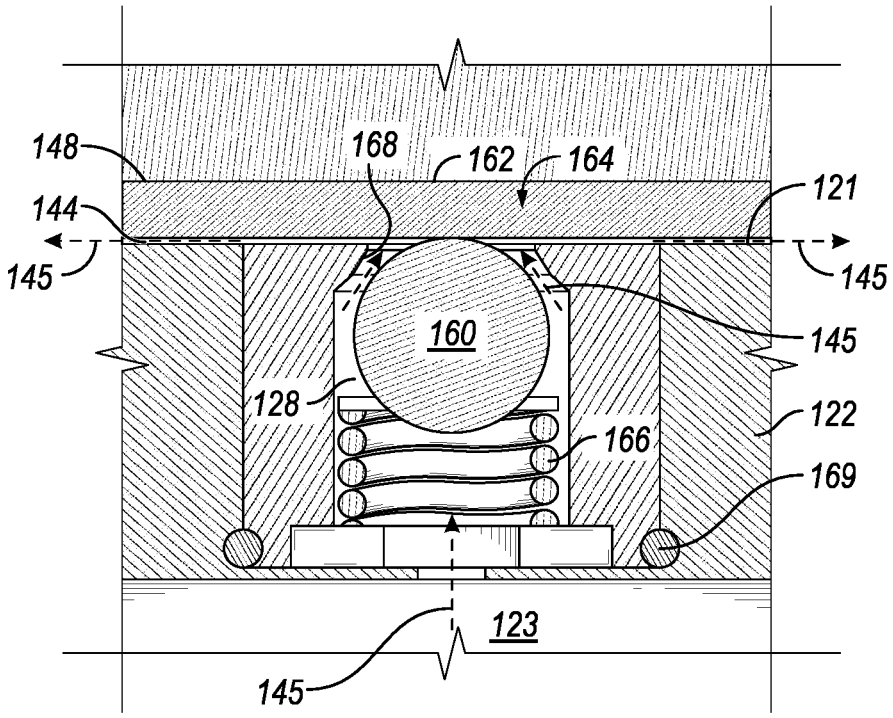
FIG. 4 is an enlarged view of the portion around the setting port of FIG. 3.

FIG. 4 is an enlarged view of the portion around the setting port 128 enclosed by window 4 of FIG. 3. The guide sleeve 148 is in the first position, propping the valve element 160 open. The setting port 128 extends through a wall of the mandrel 122, from the mandrel ID 123 to the mandrel OD 121. The valve element 160 comprises a ball in this example, for sealing with a setting port 128 having a generally circular cross-section. However, any suitable valve element and complementary setting port of any shape may be used for selectively closing a setting port. The guide sleeve 148 includes a ball-engagement portion 162 aligned with the valve element 160 when the guide sleeve 148 is in the first position. The ball-engagement portion 162 engages the valve element 160 to prop it to the open position against the biasing action of a valve spring 166. In the open position, a gap is present between the valve element 160 and a valve seat 168, allowing fluid pressure flow through the setting port 128 and into the annular setting chamber 144 along a flow path generally indicated by arrows 145. A relief 164 in the guide sleeve 148 is axially spaced from the ball-engagement portion 162. To release the valve element 160 to the closed position requires shifting the sleeve 148 to the left to align the relief 164 with the valve element 160, as further discussed below. One or more seals (e.g., one or more O-rings) 169 may also be provided to avoid an unintended fluid communication path other than the space between the valve seat 168 and the valve element 160 as explained above.

Figure 5:
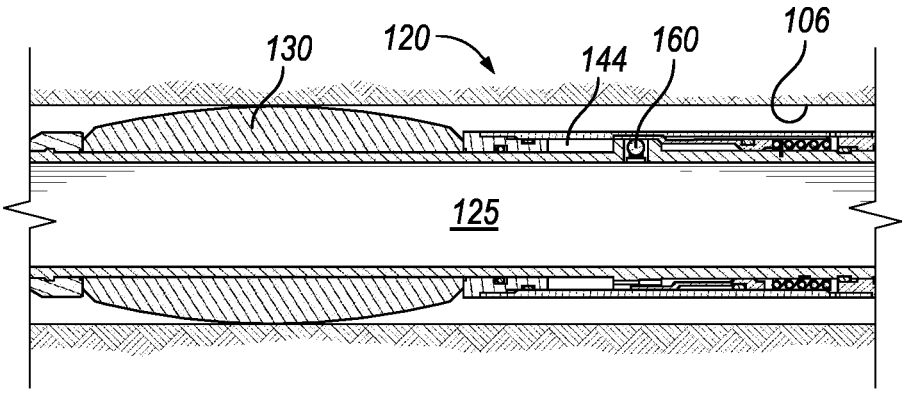
FIG. 5 is a sectional view of the packer after setting against the wellbore and pressure-isolating the setting chamber.

FIG. 5 is a sectional view of the packer 120 after setting against the wellbore 106 and pressure-isolating the setting chamber 144. The element 160 may have been set by supplying the setting pressure downhole to the mandrel through bore 125 to the setting port 128. After setting the element 160, pressure may have been bled off to release the valve element 160 to the closed position. The setting chamber is now closed, pressure-isolating the setting chamber 144. By pressure-isolating the setting chamber 144, pressure now be supplied downhole to the mandrel through bore 125 without the pressure entering the setting chamber 144. The setting chamber 144 is now isolated from pressure in the mandrel greater than was applied to the setting chamber to set the packer and release the guide sleeve 148.

Figure 6:
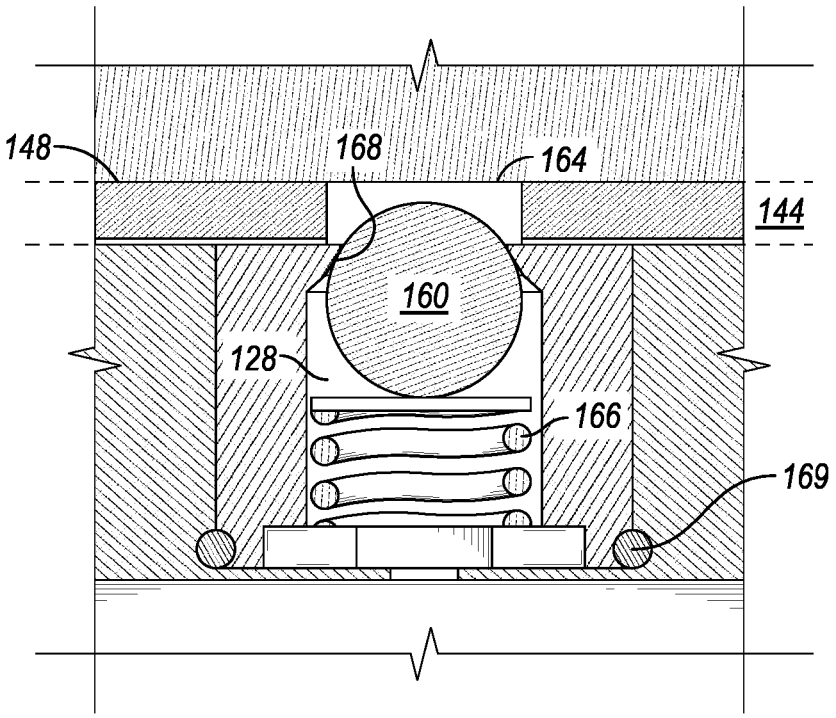
FIG. 6 is an enlarged view of the portion around the setting port after the valve element has been released to the closed position.

FIG. 6 is an enlarged view of the portion around the setting port 128 after the valve element 160 has been released to the closed position. To release the valve element 160 to the closed position, the threshold pressure may be supplied as described above to release the guide sleeve 148 (e.g., shearing a shear member) and shifting the guide sleeve 148 to the second position of FIG. 6. In the second position, the ball-engagement portion 162 has been axially shifted away from the valve element 160 and align the relief 164 in the guide sleeve 148 with the valve element 160. The valve element 160, having previously been retained in the open position by the ball-engagement portion 162 as shown in FIG. 4, has been released by alignment with the relief 164. The valve spring 166 now urges the valve element 160 into sealing engagement with the corresponding valve seat 168. The closing force provided by the valve spring 166 is sufficient to pressure-isolate the setting chamber 144. This closing force may be assisted or reinforced by any pressure subsequently supplied to the mandrel, by helping to urge the valve element 160 against the valve seat 168. Seal 169 helps avoid an unintended fluid communication path (i.e., a leak) when the valve element 160 is in the closed position.

Figure 7:
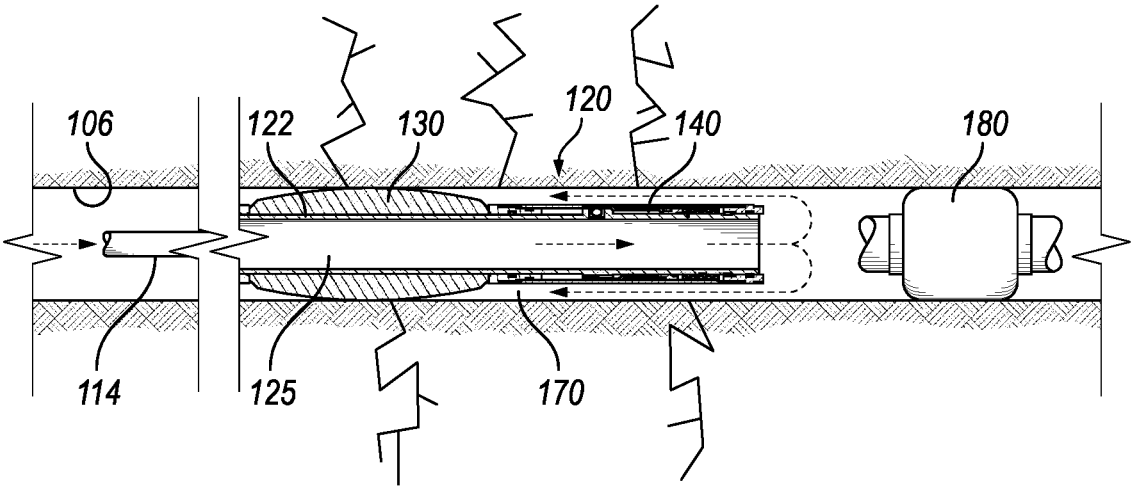
FIG. 7 is a sectional view of the packer as used in a method of servicing the wellbore according to an example method.

FIG. 7 is a sectional view of the packer 120 as used in a method of servicing the wellbore 106 according to an example method. The packer 120, which includes the annular sealing element 130 and setting mechanism 140, has been lowered into the wellbore on the tubular conveyance 114. The tubular conveyance 114 is coupled to the packer 120 with the tubular conveyance 114 in fluid communication with the mandrel through bore 125. The packer 120 was run into the wellbore 106 in a run-in condition (e.g., **120*a* of FIG. 1), and subsequently set in the current position by supplying a setting pressure downhole via the tubular conveyance 114. The element 130 has been outwardly deployed into engagement with the wellbore 106, thereby sealing an annulus 170 between the packer 120 and the wellbore 106. The setting chamber is then isolated as described above, after which pressures may supplied to the mandrel through bore 125** in excess of the pressures used to set the packer. This pressure isolation allows higher pressures to now be delivered downhole, without damaging components of the setting chamber that may be rated for lower pressures required to set the packer.

A wellbore service may now be performed comprising delivering a service fluid down through the mandrel 122 and into the annulus 170 sealed by the annular sealing element 130. By having isolated the setting chamber, fluid pressure may now be supplied to the mandrel in excess of the setting pressure and threshold pressure For example, the service fluid may be pressurized to at least 50% greater than the setting pressure. In one example, the packer may be set with a setting pressure of 5,000 psi (34 MPa) or less, and the service fluid may be pressurized up to two or three times that pressure. The wellbore is shown as being closed downhole of the packer 120, such as with a plug 180 or any other device, so that the service fluid is constrained to flow out of the mandrel 122 and out into the annulus 170. In one example, the service fluid may be a proppant-laden hydraulic fracturing fluid used to form fractures 182 in the formation 108. However, any wellbore servicing operation may be employed, with fluid pressures that may exceed the pressures supplied to set the packer and subsequently isolate the setting mechanism.

Accordingly, the present disclosure may provide a well sealing tool and related devices and methods for sealing a wellbore, wherein the setting mechanism used to set the well sealing tool is subsequently pressure isolated. Although the disclosed example tools use an element-setting piston that is hydraulically driven by the setting pressure, other embodiments may be devised. For example, an inflatable packer according to this disclosure may use a setting pressure to inflate a packer rather than to drive an element-setting piston into engagement with the element. In that case, pressures may still be used to release a valve element as described to subsequently pressure isolate the setting chamber after setting the packer.

It should also be recognized that the principles of this disclosure to set and then pressure isolate a well sealing device are not limited to packers. These principles may be applied to other well sealing tools used to seal against any downhole surface, such as with a casing or between two tubular members downhole.

The disclosed methods/systems/tools may include any of the various features disclosed herein, including one or more of the following statements.

Statement 1. A packer setting mechanism, comprising: a setting chamber housing positionable about a mandrel to define at least a portion of a setting chamber between the mandrel and the setting chamber housing; a setting port fluidically coupling a through bore of the mandrel with the setting chamber; a valve element biased toward a closed position within the setting port; and a guide sleeve disposed about the mandrel in a first position that props the valve element to an open position, the guide sleeve moveable to a second position in response to a threshold pressure applied to the setting chamber that releases the valve element to the closed position.

Statement 2. The packer setting mechanism of Statement 1, further comprising: an element-setting piston exposed to the setting chamber, the element-setting piston moveable into engagement with an annular sealing element in response to a setting pressure applied to the setting chamber.

Statement 3. The packer setting mechanism of Statement 1 or 2, further comprising: a guide sleeve piston exposed to the setting chamber and coupled to the guide sleeve, the guide sleeve piston moveable in response to the threshold pressure applied to the setting chamber.

Statement 4. The packer setting mechanism of Statement 3, further comprising a shear member initially securing the guide sleeve in the first position, the shear member configured to shear in response to the threshold pressure applied to the guide sleeve piston.

Statement 5. The packer setting mechanism of Statement 3, further comprising a spring biasing the guide sleeve to the second position.

Statement 6. The packer setting mechanism of any of Statements 1-3, further comprising an element-setting piston and a guide sleeve piston axially opposite one another with respect to the setting port.

Statement 7. The packer setting mechanism of Statement 6, wherein the guide sleeve moves axially away from the setting port in response to the threshold pressure, and the spring biases the guide sleeve back toward the setting port in response to bleeding off the threshold pressure.

Statement 8. The packer setting mechanism of any of Statements 1-7, wherein the threshold pressure is greater than the setting pressure.

Statement 9. The packer setting mechanism of any of Statements 1-8, wherein releasing the valve element to the closed position isolates the setting chamber to pressure in the mandrel of at least 50% higher than the setting pressure.

Statement 10. A wellbore sealing tool, comprising: a mandrel positionable in a wellbore and defining a mandrel through bore for fluid communication with a tubular conveyance; an annular sealing element disposed about the mandrel; a setting mechanism including a setting chamber and a setting port along the mandrel fluidically coupling the mandrel through bore to the setting chamber, the setting mechanism configured for deploying the sealing element outwardly in response to a setting pressure applied to the setting chamber through the setting port; a valve element moveable between an open position and a closed position with respect to the setting port; and a guide member initially propping the valve element to the open position and then releasing the valve element to the closed position in response to a threshold pressure applied to the setting chamber through the setting port.

Statement 11. The wellbore sealing tool of Statement 10, wherein the setting mechanism further comprises an element-setting piston disposed on the mandrel exposed to the setting chamber, wherein the setting pressure applied to the element-setting piston deploys the sealing element outwardly into engagement with the wellbore.

Statement 12. The wellbore sealing tool of Statement 11 or 12, wherein the setting mechanism further comprises: a shear member initially securing the guide member in a first position initially propping the valve element to the open position; and a guide member piston coupled to the guide member for shearing the shear member in response to the threshold pressure applied to the guide member piston.

Statement 13. The wellbore sealing tool of Statement 12, wherein the threshold pressure at which the shear member is configured to shear is greater than or equal to the setting pressure applied to the element-setting piston to deploy the sealing element outwardly into engagement with the wellbore.

Statement 14. The wellbore sealing tool of Statement 12 or 13, wherein the element-setting piston and the guide member piston are on opposite sides of the setting port to be urged axially away from one another in response to pressure supplied to the setting chamber.

Statement 15. The wellbore sealing tool of any of Statements 12-14, further comprising a biasing member for biasing the guide member toward a second position, wherein the guide member is initially moved away from the second position in response to the threshold pressure before the biasing member urges the guide sleeve to a second position releasing the valve element to the closed position.

Statement 16. A method of sealing a wellbore, comprising: lowering an annular sealing element on a mandrel into a wellbore; initially propping a valve element in an open position with a guide sleeve to hold open a setting port along the mandrel; supplying a setting pressure through the setting port into a setting chamber defined about the mandrel to deploy the annular sealing element into engagement with the wellbore; and moving the guide sleeve to release the valve element to a closed position closing the setting port, thereby isolating the setting chamber to pressures greater than the setting pressure.

Statement 17. The method of Statement 16, further comprising: performing a wellbore service comprising delivering a service fluid down through the mandrel and into an annulus sealed by the annular sealing element, wherein the service fluid is pressurized to greater than the setting pressure.

Statement 18. The method of Statement 16 or 17, wherein moving the guide sleeve to release the valve element comprises applying a threshold pressure through the setting port into the setting chamber to shear a shear member initially preventing movement of the guide sleeve to release the valve element.

Statement 19. The method of any of Statements 16-19, further comprising: biasing the valve element toward a closed position using a first biasing member, to urge the valve element to the closed position when released by the guide sleeve; and biasing the guide sleeve from a first position propping the valve element in the open position to a second position at which the guide sleeve releases the valve element.

Statement 20. The method of any of Statements 17-19, wherein the setting chamber is isolated to pressures in excess of a maximum pressure rating of the setting chamber.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A packer setting mechanism, comprising:

a setting chamber housing positionable about a mandrel to define at least a portion of a setting chamber between the mandrel and the setting chamber housing;

a setting port fluidically coupling a through bore of the mandrel with the setting chamber;

a valve element biased toward a closed position within the setting port; and a guide sleeve disposed about the mandrel in a first position that props the valve element to an open position, the guide sleeve moveable to a second position in response to a threshold pressure applied to the setting chamber that releases the valve element to the closed position.

2. The packer setting mechanism of claim 1, further comprising:

an element-setting piston exposed to the setting chamber, the element-setting piston moveable into engagement with an annular sealing element in response to a setting pressure applied to the setting chamber.

3. The packer setting mechanism of claim 2, wherein the threshold pressure is greater than the setting pressure.

4. The packer setting mechanism of claim 2, wherein releasing the valve element to the closed position isolates the setting chamber to a pressure in the mandrel of at least 50% higher than the setting pressure.

5. The packer setting mechanism of claim 1, further comprising:

a guide sleeve piston exposed to the setting chamber and coupled to the guide sleeve, the guide sleeve piston moveable in response to the threshold pressure applied to the setting chamber.

6. The packer setting mechanism of claim 5, further comprising a shear member initially securing the guide sleeve in the first position, the shear member configured to shear in response to the threshold pressure applied to the guide sleeve piston.

7. The packer setting mechanism of claim 5, further comprising a spring biasing the guide sleeve to the second position.

8. The packer setting mechanism of claim 1, further comprising an element-setting piston and a guide sleeve piston axially opposite one another with respect to the setting port.

9. The packer setting mechanism of claim 8, wherein the guide sleeve moves axially away from the setting port in response to the threshold pressure, and a spring biases the guide sleeve back toward the setting port in response to bleeding off the threshold pressure.

10. A wellbore sealing tool, comprising:

a mandrel positionable in a wellbore and defining a mandrel through bore for fluid communication with a tubular conveyance;

an annular sealing element disposed about the mandrel;

a setting mechanism including a setting chamber and a setting port along the mandrel fluidically coupling the mandrel through bore to the setting chamber, the setting mechanism configured for deploying the sealing element outwardly in response to a setting pressure applied to the setting chamber through the setting port;

a valve element moveable between an open position and a closed position with respect to the setting port; and a guide member initially propping the valve element to the open position and then releasing the valve element to the closed position in response to a threshold pressure applied to the setting chamber through the setting port.

11. The wellbore sealing tool of claim 10, wherein the setting mechanism further comprises an element-setting piston disposed on the mandrel exposed to the setting chamber, wherein the setting pressure applied to the element-setting piston deploys the sealing element outwardly into engagement with the wellbore.

12. The wellbore sealing tool of claim 11, wherein the setting mechanism further comprises:

a shear member initially securing the guide member in a first position initially propping the valve element to the open position; and a guide member piston coupled to the guide member for shearing the shear member in response to the threshold pressure applied to the guide member piston.

13. The wellbore sealing tool of claim 12, wherein the threshold pressure at which the shear member is configured to shear is greater than or equal to the setting pressure applied to the element-setting piston to deploy the sealing element outwardly into engagement with the wellbore.

14. The wellbore sealing tool of claim 12, wherein the element-setting piston and the guide member piston are on opposite sides of the setting port to be urged axially away from one another in response to pressure supplied to the setting chamber.

15. The wellbore sealing tool of claim 12, further comprising a biasing member for biasing the guide member toward a second position, wherein the guide member is initially moved away from the second position in response to the threshold pressure before the biasing member urges the guide member to a second position releasing the valve element to the closed position.

16. A method of sealing a wellbore, comprising:

lowering an annular sealing element on a mandrel into the wellbore;

initially propping a valve element in an open position with a guide sleeve to hold open a setting port along the mandrel;

supplying a setting pressure through the setting port into a setting chamber defined about the mandrel to deploy the annular sealing element into engagement with the wellbore; and moving the guide sleeve to release the valve element to a closed position closing the setting port, thereby isolating the setting chamber to pressures greater than the setting pressure.

17. The method of claim 16, further comprising:

performing a wellbore service comprising delivering a service fluid down through the mandrel and into an annulus sealed by the annular sealing element, wherein the service fluid is pressurized to greater than the setting pressure.

18. The method of claim 17, wherein the setting chamber is isolated to pressures in excess of a maximum pressure rating of the setting chamber.

19. The method of claim 16, wherein moving the guide sleeve to release the valve element comprises applying a threshold pressure through the setting port into the setting chamber to shear a shear member initially preventing movement of the guide sleeve to release the valve element.

20. The method of claim 16, further comprising:

biasing the valve element toward the closed position using a first biasing member, to urge the valve element to the closed position when released by the guide sleeve; and biasing the guide sleeve from a first position propping the valve element in the open position to a second position at which the guide sleeve releases the valve element.

* * * * *